US007036664B2

(12) United States Patent
Lee et al.

(10) Patent No.: US 7,036,664 B2
(45) Date of Patent: May 2, 2006

(54) METHOD AND APPARATUS FOR MAKING AND LOCKING MEMBERS FOR DISPENSING PACKAGING PRODUCTS

(75) Inventors: Kendrew Lee, Fremont, CA (US); Yasuhiro Yamamoto, San Francisco, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 122 days.

(21) Appl. No.: 10/224,810

(22) Filed: Aug. 20, 2002

(65) Prior Publication Data

US 2004/0035746 A1 Feb. 26, 2004

(51) Int. Cl.

| | |
|---|---|
| ***B65D 73/00*** | (2006.01) |
| ***B65D 85/00*** | (2006.01) |
| ***B65D 43/12*** | (2006.01) |
| ***B65H 1/00*** | (2006.01) |

(52) U.S. Cl. ..... 206/468; 206/1.5; 206/705; 220/8; 220/345.3; 221/197; 221/305

(58) Field of Classification Search ..... 206/467–469, 206/471, 461–465, 703, 705, 1.5; 220/8, 220/345.1, 4.21, 4.31, 345.3; 221/197, 305, 221/312 C See application file for complete search history.

(56) References Cited

U.S. PATENT DOCUMENTS

| | | | | |
|---|---|---|---|---|
| 2,577,862 | A * | 12/1951 | Shaw, Jr. | 312/42 |
| 3,254,761 | A * | 6/1966 | Hennessey et al. | 206/484 |
| 4,174,034 | A * | 11/1979 | Hoo | 206/1.5 |
| 4,844,284 | A * | 7/1989 | Drozd et al. | 206/1.5 |
| 4,955,529 | A * | 9/1990 | Barnhart | 221/305 |
| 5,080,222 | A * | 1/1992 | McNary | 206/1.5 |
| 5,390,821 | A * | 2/1995 | Markel | 221/305 |
| 5,407,094 | A * | 4/1995 | Vajtay | 221/193 |
| 5,562,212 | A * | 10/1996 | Rosler | 206/443 |
| 2001/0040115 | A1 * | 11/2001 | Wani et al. | 206/705 |

* cited by examiner

*Primary Examiner*—Bryon P. Gehman
(74) *Attorney, Agent, or Firm*—LaRiviere, Grubman & Payne, LLP

(57) ABSTRACT

A method and an apparatus for packaging, displaying, dispensing, and storing at least one product, having an inner packaging member and an outer packaging member, the outer packaging member being slidably mounted over the inner packaging member. The inner packaging member may have a structure for retaining a product, such a compartment, a structure for separating the compartment, such as a wall, a complementary contour for accommodating the product, such as a power or a battery cell. The outer packaging member may have a backing member, such as at least one insert, a flange for accommodating and supporting the at least one insert, a roof member, and a section for accommodating an advertisement of the at least one product. The packaging apparatus may have a structure for mating and locking the outer packaging member to the inner packaging member for facilitating engagement and disengagement. The outer packaging member and the inner packaging member may together have a complementary geometric configuration.

38 Claims, 4 Drawing Sheets

METHOD AND APPARATUS FOR MAKING AND LOCKING MEMBERS FOR DISPENSING PACKAGING PRODUCTS

CROSS-REFERENCE TO RELATED APPLICATION(S)

The present application is technologically related to a concurrently filed U.S. design patent application Ser. No. 10/838,776.

COPYRIGHT NOTICE AND LIMITED AUTHORIZATION FOR USE

A portion of the disclosure of the present patent application contains material which is subject to copyright protection. The copyright owner has no objection to the facsimile reproduction by anyone of the patent document or the patent disclosure, as it appears in the United States Patent and Trademark Office patent file or records, but otherwise reserves all rights under the copyright laws of the United States (17 U.S.C. §106).

FIELD OF THE INVENTION

The present invention involves product packaging. More particularly, the present invention involves electronic product packaging. Even more specifically, the present invention involves power cell packaging for display, dispensing, and storing.

BACKGROUND OF THE INVENTION

Currently, electronic products are typically sold in a hard plastic packaging. With respect to the current art hard plastic packaging, the consumer must cut through the plastic using heavy shears in order to access the electronic product, risking personal injury from the newly cut packaging edges. Because the current art plastic packaging is typically heavy gauge, substantial internal stresses will develop in the package during the consumer's attempt to remove the product. During such attempted removal, the cut packaging may, and often does, spring-back on the consumer, thereby causing personal injury. In addition, the current art hard plastic packaging, once cut, cannot readily store nor dispense the product. The consumer must find other means for storing and dispensing the product. When the product is a battery cell, safe, convenient storage and convenient dispensing is of utmost concern. As such, a long-felt need is seen to exist for a packaging method and apparatus for safely and conveniently packaging, displaying, storing, and dispensing of electronic products, especially of battery cells.

BRIEF SUMMARY OF THE INVENTION

Accordingly, the present invention addresses this long-felt need for a packaging method and apparatus which safely and conveniently packages, displays, stores, and dispenses an electronic product, such as a battery cell. Generally, the present method and apparatus for packaging a product for display, such as a retail sales display, involves an inner packaging member and an outer packaging member, the outer packaging member being slidably mounted over the inner packaging member.

The inner packaging member may have a structure for retaining at least one product, such as at least one compartment. The retaining structure may also have a structure for separating the at least one compartment, such as a wall structure. The at least one compartment may have at least one complementary contour for accommodating the at least one product. The at least one product may be at least one power or battery cell. The inner packaging member and the outer packaging member may each have at least one coincident orifice for facilitating displaying the at least one product by hanging. The inner packaging member may be formed from a material having an optical property such as transparency, translucency, and opacity. The inner packaging member may have a floor member for facilitating standing of the apparatus on a horizontal surface.

The outer packaging member may be formed from a material having an optical property such as transparency and translucency. The outer packaging member may also have a backing member, such as at least one insert. The outer packaging member may also have at least two flanges for accommodating and supporting the at least one insert. The outer packaging member may also have a roof member. The outer packaging member may also have a section for accommodating an advertisement of the at least one product.

The packaging apparatus may further have a structure for mating and locking the outer packaging member to the inner packaging member. The mating and locking structure may be provided by at least one recess formed in the inner packaging member and at least one complementary formed on the outer packaging member to be inserted into the at least one recess. The mating and locking structure may operate using at least one mechanism, such as a compression-fit and an interference-fit. The mating and locking structure facilitates quick-engagement and quick-disengagement of the inner packaging member and the outer packaging member. The outer packaging member and the inner packaging member may also together have a complementary geometric configuration. The outer packaging member and the inner packaging member together may form a hopper/feeder arrangement for dispensing the at least one product by gravity-feed.

Advantages of the present invention include, but are not limited to, rapid engagement and disengagement of the packaging portions, thereby eliminating the related art need for scissors to cut through the typically thick polymer packaging in order to access the product; reducing the chance of injury to the consumer by eliminating the sharp edges arising from cutting related art packages; and providing easy dispensing of the product by gravity-feed. Other features of the present invention are disclosed, or are apparent in the section entitled "Detailed Description of the Invention."

BRIEF DESCRIPTION OF THE DRAWING

For a better understanding of the present invention, reference is made to the below-referenced accompanying Drawing. Reference numbers refer to the same or equivalent parts of the present invention throughout the several figures of the Drawing.

DETAILED DESCRIPTION OF THE INVENTION

Figure 1:
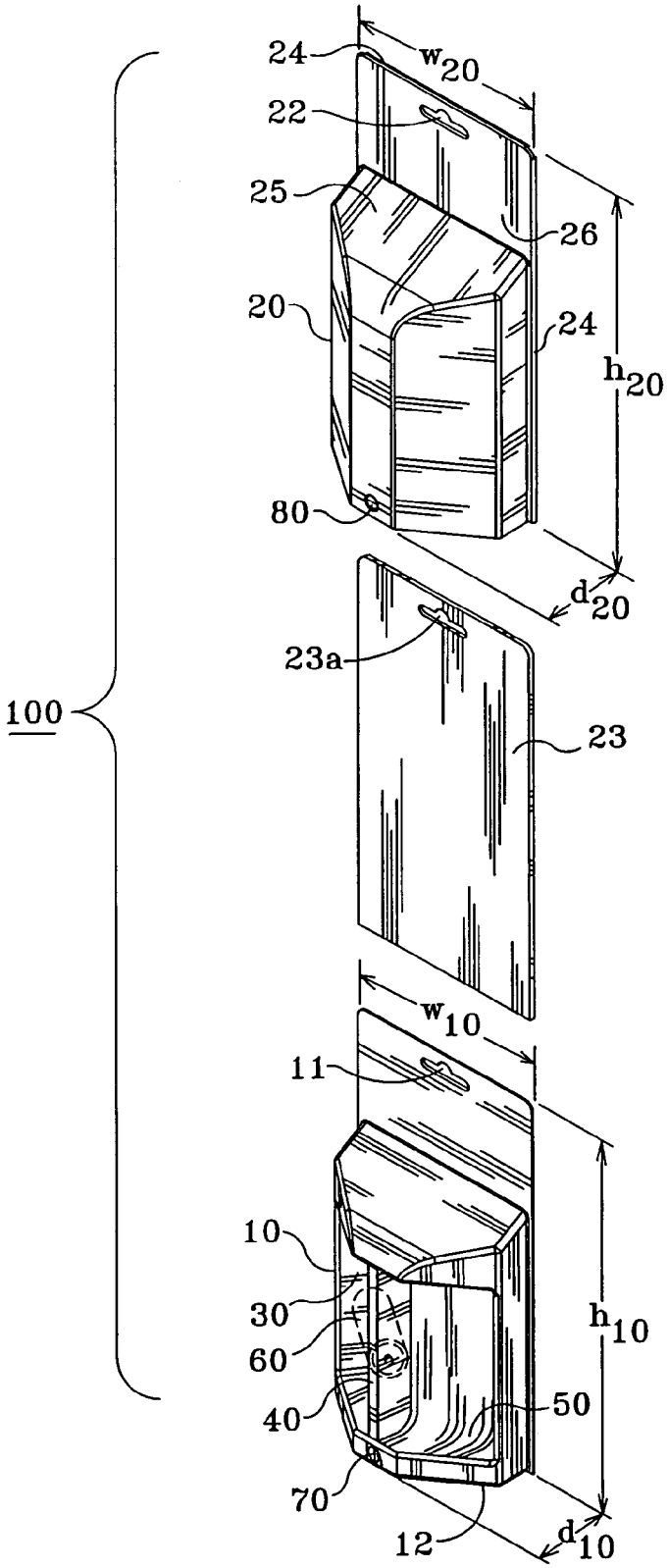
FIG. 1 is a perspective view of the apparatus for packaging, displaying, dispensing, and storing at least one product in a dissembled state, in accordance with the present invention.

FIG. 1 illustrates, in a perspective view, the apparatus 100 for packaging, displaying, dispensing, and storing at least one product 60, in a dissembled state, in accordance with the present invention. The product display packaging apparatus 100 comprises an inner packaging member 10 and an outer packaging member 20, the outer packaging member 20 being slidably mounted over the inner packaging member 10. The inner packaging member 10 may comprise means for retaining at least one product 60, such as at least one compartment 30. The retaining means may comprise means for separating the at least one compartment 30, such as a wall structure 40. The at least one compartment 30 may comprises at least one complementary contour 50 for accommodating the at least one product 60, such as at least one battery cell.

The apparatus 100, as shown in FIG. 1, may further comprise means for mating and locking the outer packaging member 20 to the inner packaging member 10. The mating and locking means may comprise at least one recess 70 formed in the inner packaging member 10 and at least one complementary protuberance 80 formed on the outer packaging member 20 to be inserted into the at least one recess 70. The mating and locking means providing step facilitates engaging the inner packaging member 10 with the outer packaging member 20 and disengaging the inner packaging member 10 from the outer packaging member 20. The mating and locking means comprises at least one mechanism selected from a group consisting essentially of a compression-fit and an interference-fit.

The inner packaging member 10 and the outer packaging member 20, as shown in FIG. 1, may respectively comprise at least one coincident orifice 11, 22 for facilitating displaying the at least one product by hanging. The inner packaging member 10 may comprise a material having an optical property selected from a group consisting essentially of transparency, translucency, and opacity. The inner packaging member 10 may also comprise variable dimensions (i.e., width $w_{10}$, height $h_{10}$, and depth $d_{10}$) for accommodating at least one variable aspect of the at least one product 60 selected from a group consisting essentially of size (e.g., AA, AAA, C, D for battery cell products), shape (e.g., rectangular or circular for battery cell products), and number (i.e., an integer).

The outer packaging member 20, as shown in FIG. 1, may comprise a material having an optical property selected from a group consisting essentially of transparency and translucency. The outer packaging member 20 may comprise a backing member, such as at least one insert 23 having a coincident orifice 23*a*. The outer packaging member 20 may comprise at least two flanges 24 for accommodating and supporting the at least one insert 23. The outer packaging member 20 may comprise a roof member 25; and the inner packaging member 10 may comprise a floor member 12. The outer packaging member 20 and the inner packaging member 10 together may comprise a complementary geometric configuration. The outer packaging member 20 may also comprise a section 26 for accommodating an advertisement of the at least one product 60. The outerpackaging member 20 may also comprise variable dimensions (i.e., width, $w_{20}$, height $h_{20}$, and depth $d_{20}$) for accommodating at least one variable aspect of the at least one product 60 selected from a group consisting essentially of size (e.g., AA, AAA, C, D for battery cell products), shape (e.g., rectangular or circular for battery cell products), and number (i.e., an integer).

Figure 2:
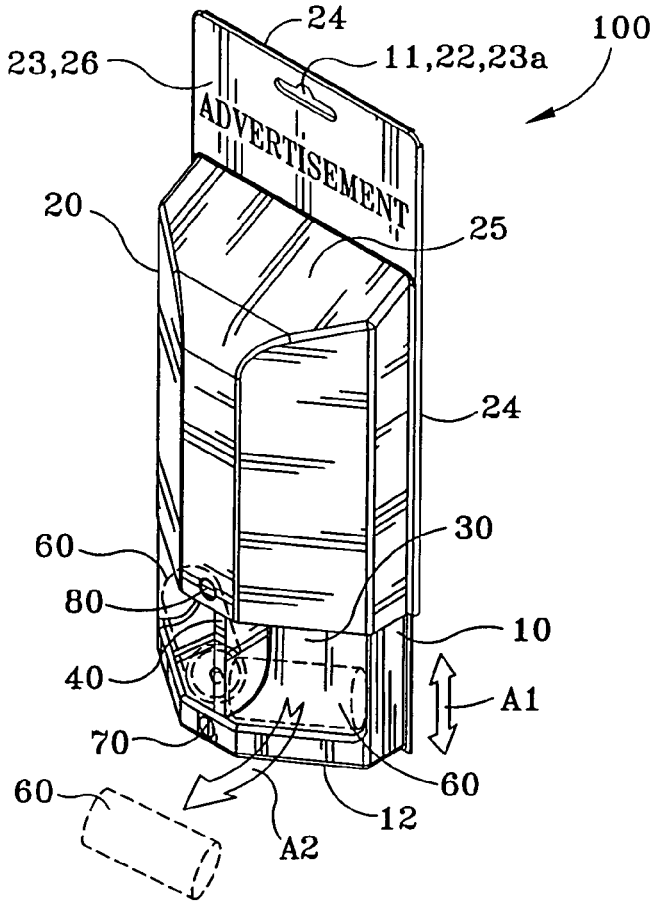
FIG. 2 is a perspective view of the apparatus of FIG. 1, in a partially assembled state, illustrating the feeder/hopper operation, in accordance with the present invention.

FIG. 2 illustrates, in a perspective view, the apparatus 100 of FIG. 1, in a partially assembled state, illustrating the feeder/hopper operation, in accordance with the present invention. The apparatus 100 may be may be partially dissembled by unlocking the mating and locking structure 70, 80 and by subsequently moving the outer packaging member 20 upward from the inner packaging member 10 to a distance which is approximately equal to a width of the at least one product 60, such as a battery cell, as shown by the bidirectional arrow A1, whereby the at least one product 60, may be gravity-fed down the at least one compartment 30 (i.e., hopper), and thereby releasing the at least one product 60 from the apparatus 100 as shown by the arrow A2. The apparatus 100 may be may be reassembled by re-locking the mating and locking structure 70, 80 and by subsequently moving the outer packaging member 20 downward to the inner packaging member 10, as shown by the bidirectional arrow A1, whereby the at least one product will no longer be gravity-fed down the at least one compartment 30, and thereby safely storing the remaining at least one product 60 for later use.

Figure 3:
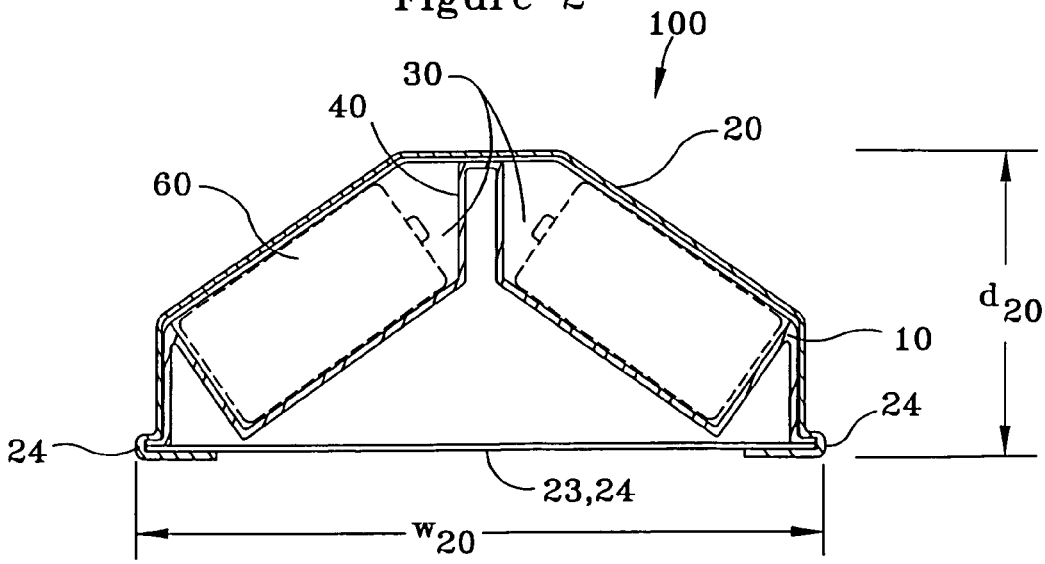
FIG. 3 is a width-wise cross-sectional view of the apparatus of FIG. 1, illustrating the disposition of the product being packaged, in accordance with the present invention.

FIG. 3 illustrates, in a width-wise cross-sectional view, the apparatus 100 of FIG. 1, illustrating the disposition of the at least one product 60 being packaged, in accordance with the present invention. For example only, at least one product 60, such as a battery cell, is disposed in the at least one compartment 30. At least two compartments 30 may be separated by at least one wall 40, as shown. The insert 23 may be slidably mounted by the at least one flange 24.

Figure 4:
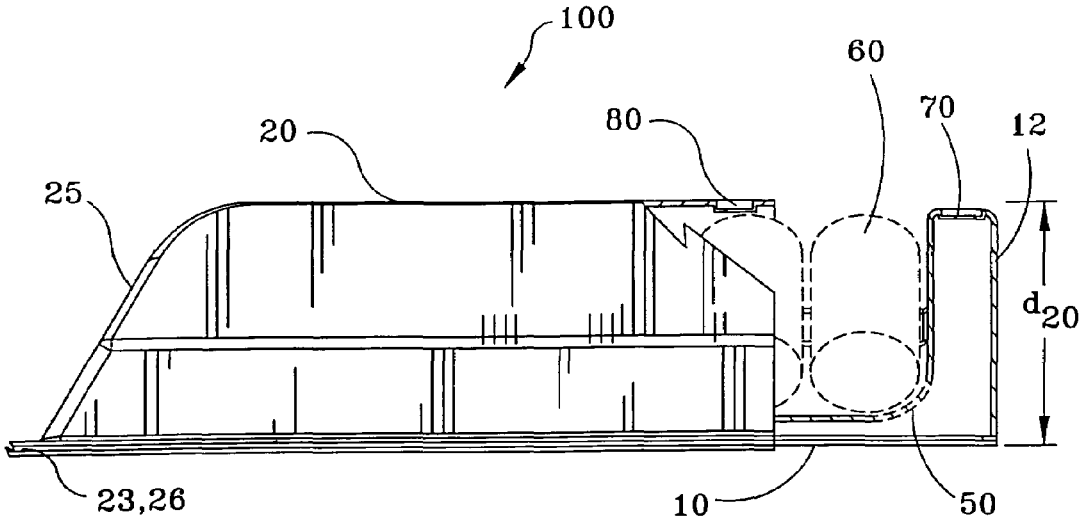
FIG. 4 is a height-wise cross-sectional view of the apparatus of FIG. 1, illustrating the dissembled mating and locking structure, in accordance with the present invention.

FIG. 4 illustrates, in a height-wise cross-sectional view, the apparatus 100 of FIG. 1, illustrating the dissembled mating and locking structure 70, 80, in accordance with the present invention. The at least one compartment 30 may comprise the contour 50, corresponding to the shape of the at least one product, as shown. The floor 12 retains the remaining at least one product within the apparatus 100 and also facilitates standing of the apparatus on a horizontal surface.

Figure 5:
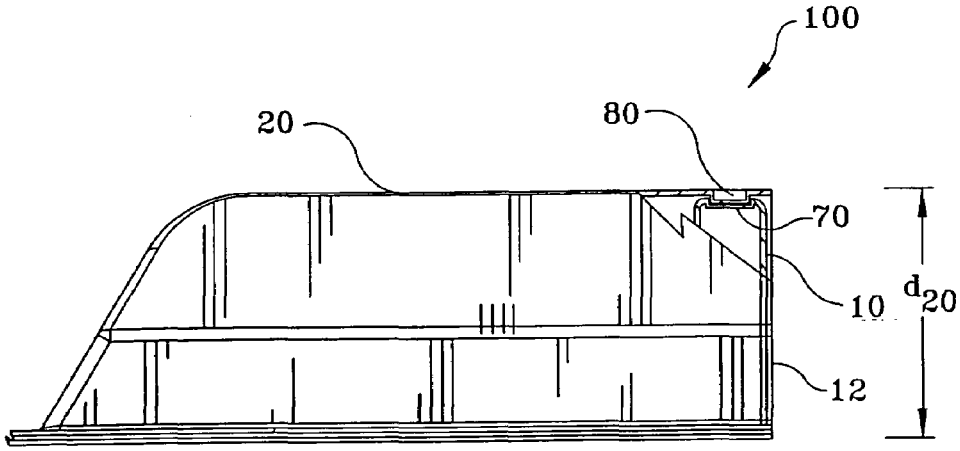
FIG. 5 is a height-wise cross-sectional view of the apparatus of FIG. 1, illustrating the assembled mating and locking structure, in accordance with the present invention.

FIG. 5 illustrates, in a height-wise cross-sectional view, the apparatus 100 of FIG. 1, illustrating the assembled mating and locking structure 70, 80, in accordance with the present invention. The mating and locking structure 70, 80 may operate through a mechanism such as a compression-fit and/or an interference fit.

Figure 6:
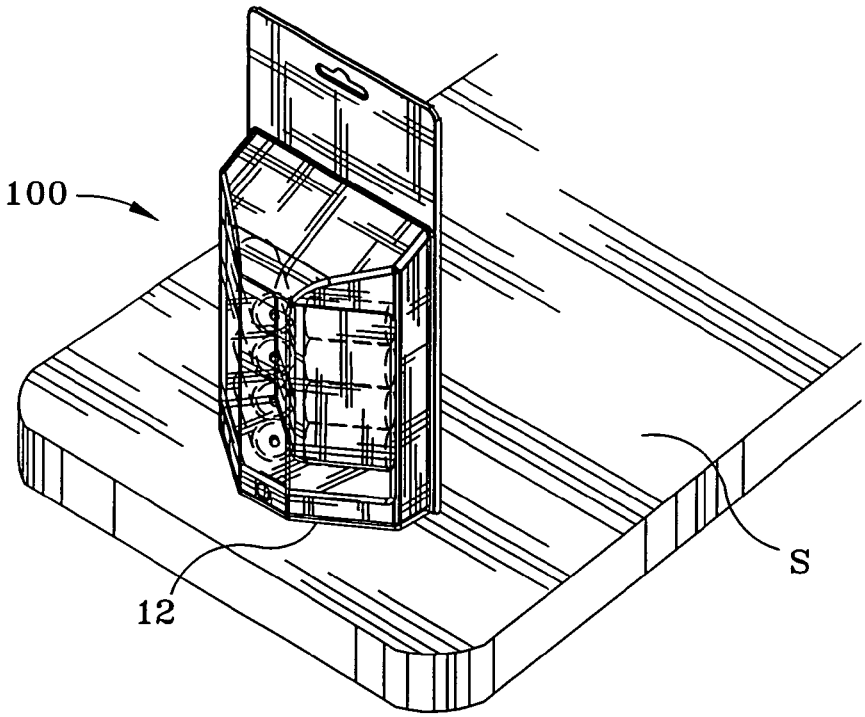
FIG. 6 is a perspective view of the apparatus of FIG. 1, in an assembled state, illustrating its disposition on a horizontal surface, such as a display table, in accordance with the present invention.

FIG. 6 illustrates, in a perspective view, the apparatus 100 of FIG. 1, in an assembled state, showing its disposition on a horizontal surface S, such as a display table or a consumer workbench, in accordance with the present invention. The apparatus 100 is, thus, useful to both the retailer and the consumer in that the packaged product may be stored on any horizontal surface S as the at least one product 60 is maintained in the apparatus 100 by the floor 12, which facilitates standing of the apparatus on the horizontal surface S, and by the mating and locking structure 70, 80.

Figure 7:
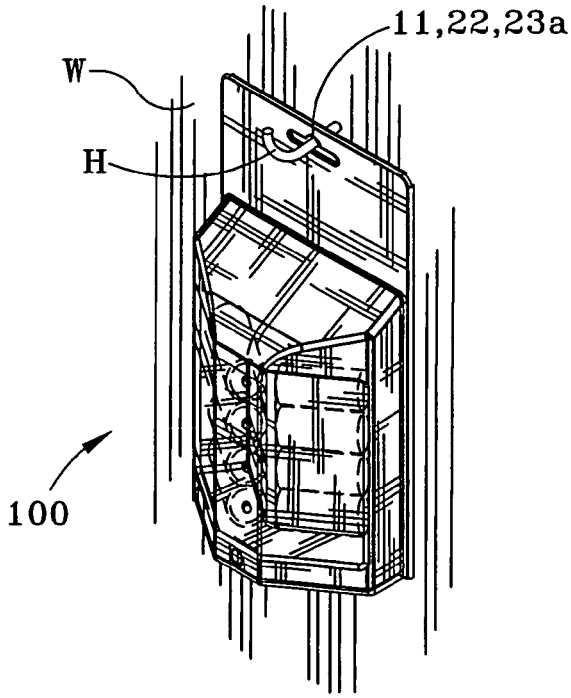
FIG. 7 is a is a perspective view of the apparatus of FIG. 1, in an assembled state, illustrating its disposition as being hung on a vertical surface, such as a display wall, in accordance with the present invention.

FIG. 7 illustrates, in a perspective view, the apparatus 100 of FIG. 1, in an assembled state, illustrating its disposition as being hung on a vertical surface, such as a display wall W, using means for hanging H, such as a hook, in accordance with the present invention. The apparatus 100 is, thus, useful to both the retailer and the consumer in that the packaged product may be stored on any vertical surface as the at least one product 60 is maintained in the apparatus 100 by the mating and locking structure 70, 80.

A method of packaging, displaying, dispensing, and storing at least one product 60, comprises the steps of providing an inner packaging member 10, providing an outer packaging member 20, slidably mounting the outer packaging member 20 over the inner packaging member 10. The inner packaging member 10 providing step may comprise providing means for retaining at least one product, such as at least one compartment 30. The retaining means providing step may comprise providing means for separating the at least one compartment 30, such as a wall structure 40. The at least one compartment 30 providing step may comprise providing at least one complementary contour 50 for accommodating the at least one product 60, such as at least one battery cell.

The present method may further comprise providing means for mating and locking the outer packaging member 20 to the inner packaging member 10. The mating and locking means providing step may comprise providing at least one recess 70 in the inner packaging member 10 and providing at least one complementary protuberance 80 on the outer packaging member 20, the at least one protuberance 80 for inserting into the at least one recess 70. The mating and locking means providing step facilitates engaging the inner packaging member 10 with the outer packaging member 20 and disengaging the inner packaging member 10 from the outer packaging member 20. The mating and locking structure 70, 80 providing step may comprise using at least one mechanism selected from a group consisting essentially of a compression-fit and an interference-fit.

The inner packaging member 10 providing step and the outer packaging member 20 providing step may respectively comprise providing at least one coincident orifice 11, 22 for facilitating displaying the at least one product 60 by hanging. The inner packaging member 10 providing step may comprise providing the inner packaging member 10 comprising a material having an optical property selected from a group consisting essentially of transparency, translucency, and opacity. The inner packaging member 10 providing step may also comprise providing the inner packaging member 10 in variable dimensions (i.e., width $w_{10}$, height $h_{10}$, and depth $d_{10}$) for accommodating at least one variable aspect of the at least one product 60 selected from a group consisting essentially of size (e.g., AA, AAA, C, D for battery cell products), shape (e.g., rectangular or circular for battery cell products), and number (i.e., an integer).

The outer packaging member 20 providing step may comprise providing the outer packaging member 20 comprising a material having an optical property selected from a group consisting essentially of transparency and translucency. The outer packaging member 20 providing step may comprise providing a backing member, such as at least one insert 23 having a coincident orifice 23*a*. The outerpackaging member 20 providing step may comprise providing at least two flanges 24 for accommodating and supporting the at least one insert 23. The outer packaging member 20 providing step may comprise providing a roof member 25; and the step of providing the inner packaging member 10 may comprise providing a floor member 12 for facilitating standing of the apparatus on a horizontal surface. The outer packaging member 20 and the inner packaging member 10 together may comprise providing a complementary geometric configuration. The outer packaging member 20 providing step may also comprise providing a section 26 for accommodating an advertisement 26 of the at least one product 60. The outer packaging member 20 providing step may also comprise providing the outer packaging member 20 in variable dimensions (i.e., width $w_{20}$, height $h_{20}$, and depth $d_{20}$) for accommodating at least one variable aspect of the at least one product 60 selected from a group consisting essentially of size (e.g., AA, AAA, C, D for battery cell products), shape (e.g., rectangular or circular for battery cell products), and number (i.e., an integer).

While the particular method and apparatus, as herein shown and described in detail, are fully capable of attaining the above-described advantages of the invention, the presently preferred embodiment of the present invention is understood to be merely representative of the subject matter which is broadly contemplated by the present invention, the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, semiconductor material, and fabrication material detail maybe made without departing from the spirit and scope of the inventions as set forth in the appended claims. No claim herein is to be construed under the provisions of 35 U.S.C. §112, sixth paragraph, unless the element is expressly recited using the phrase "means for."

What is claimed:

1. An apparatus for packaging, displaying, dispensing, and storing at least one product, comprising:

an inner packaging member having a complementary contour for facilitating the dispensing of the at least one product;

an outer packaging member, the outer packaging member being slidably mountable over the inner packaging member; and wherein the outer packaging member and the inner packing member together define a hopper and feeder arrangement for dispensing the at least one product by gravity-feed;

means for mating and locking the outer packaging member to the inner packaging member, wherein the mating and locking means comprises:

at least one recess formed in the inner packaging member; and at least one complementary protuberance formed on the outer packaging member to be inserted into the at least one recess, wherein the mating and locking means further comprises at least one mechanism, selected from a group consisting of a compression-fit and an interference-fit, between the at least one recess and the at least one complementary protuberance.

2. An apparatus, as recited in claim 1, wherein the inner packaging member comprises means for retaining the at least one product.

3. An apparatus, as recited in claim 2, wherein the retaining means comprises at least one compartment.

4. An apparatus, as recited in claim 3, wherein the retaining means comprises means for separating at least two compartments, and wherein each said compartment accommodates at least one product.

5. An apparatus, as recited in claim 4, wherein the separating means comprises a wall structure.

6. An apparatus, as recited in claim 3, wherein the at least one compartment comprises at least one complementary contour for accommodating the at least one product.

7. An apparatus, as recited in claim 1, wherein the at least one product comprises at least one battery cell.

8. An apparatus, as recited in claim 1, wherein the inner packaging member has at least one coincident orifice for facilitating displaying the at least one product by hanging, and wherein the outer packaging member has at least one coincident orifice for facilitating displaying the at least one product by hanging.

9. An apparatus, as recited in claim 1, wherein the inner packaging member comprises a material having an optical property selected from a group consisting of transparency, translucency, and opacity.

10. An apparatus, as recited in claim 1, wherein the outer packaging member comprises a material having an optical property selected from a group consisting of transparency and translucency.

11. An apparatus, as recited in claim 1, wherein the outer packaging member comprises at least two flanges for accommodating and supporting at least one insert.

12. An apparatus, as recited in claim 1, wherein the outer packaging member comprises a roof member, the roof member comprising an upper surface of the outer packaging member.

13. An apparatus, as recited in claim 12, wherein the inner packaging member has at least one coincident orifice for facilitating displaying the at least one product by hanging, and wherein and the outer packaging member has at least one coincident orifice for facilitating displaying the at least one product by hanging.

14. An apparatus, as recited in claim 1, wherein the inner packaging member comprises a floor member for facilitating standing of the apparatus on a horizontal surface.

15. An apparatus, as recited in claim 1, wherein the outer packaging member and the inner packaging member together comprise a complementary geometric configuration.

16. An apparatus, as recited in claim 1, wherein the outer packaging member comprises a section for accommodating an advertisement of the at least one product.

17. An apparatus, as recited in claim 1, wherein the inner packaging member comprises at least one variable dimension for accommodating at least one variable aspect of the at least one product selected from a group consisting of size, shape, and number, and wherein the outer packaging member comprises at least one variable dimension for accommodating at least one variable aspect of the at least one product selected from a group consisting of size, shape, and number.

18. An apparatus for packaging, displaying, dispensing, and storing at least one product, comprising:

an inner packaging member having a complementary contour for facilitating the dispensing of the at least one product;

an outer packaging member, the outer packaging member being slidably mountable over the inner packaging member; and wherein the outer packaging member and the inner packing member together define a hopper and feeder arrangement for dispensing the at least one product by gravity-feed;

means for mating and locking the outer packaging member to the inner packaging member, wherein the inner packaging member comprises means for retaining the at least one product, wherein the inner packaging member has at least one coincident orifice for facilitating displaying the at least one product by hanging, wherein the inner packaging member comprises a floor member for facilitating standing of the apparatus on a horizontal surface, wherein the outer packaging member has at least one coincident orifice for facilitating displaying the at least one product by hanging, wherein the outer packaging member and the inner packaging member together comprise a complementary geometric configuration, wherein the mating and locking means comprises:

at least one recess formed in the inner packaging member; and at least one complementary protuberance formed on the outer packaging member to be inserted into the at least one recess, wherein the mating and locking means further comprises at least one mechanism, selected from a group consisting of a compression-fit and an interference-fit, between the at least one recess and the at least one complementary protuberance.

19. An apparatus, as recited in claim 18, wherein the inner packaging member comprises a material having an optical property selected from a group consisting of transparency, translucency, and opacity, wherein the inner packaging member comprises at least one variable dimension for accommodating at least one variable aspect of the at least one product selected from a group consisting of size, shape, and number, wherein the retaining means comprises at least one compartment, wherein the retaining means comprises means for separating the at least one compartment, wherein the separating means comprises a wall structure, wherein the at least one compartment comprises at least one complementary contour for accommodating the at least one product, wherein the at least one product comprises at least one battery cell, wherein the outer packaging member comprises a backing member, wherein the outer packaging member comprises a roof member, wherein the outer packaging member comprises a material having an optical property selected from a group consisting of transparency and translucency, wherein the backing member comprises at least one insert, wherein the outer packaging member comprises at least two flanges for accommodating and supporting the at least one insert, wherein the outer packaging member comprises at least one variable dimension for accommodating at least one variable aspect of the at least one product selected from a group consisting of size, shape, and number, and wherein the outer packaging member and the inner packaging member together comprise a hopper/feeder arrangement for dispensing the at least one product by gravity-feed.

20. A method of packaging, displaying, dispensing, and storing at least one product, comprising the steps of:

providing an inner packaging member having a complementary contour for facilitating the dispensing of the at least one product;

providing an outer packaging member;

providing means for mating and locking the outer packaging member to the inner packaging member; and wherein the outer packaging member and the inner packing member together define a hopper and feeder arrangement for dispensing the at least one product by gravity-feed;

slidably mounting the outer packaging member over the inner packaging member using the mating and locking means, wherein the mating and locking means providing step comprises:

forming at least one recess in the inner packaging member; and forming at least one complementary protuberance on the outer packaging member to be inserted into the at least one recess, wherein the mating and locking means providing step further comprises providing at least one mechanism, selected from a group consisting of a compression-fit and an interference-fit, between the at least one recess and the at least one complementary protuberance.

21. A method, as recited in claim 20, wherein the inner packaging member providing step comprises providing means for retaining the at least one product.

22. A method, as recited in claim 21, wherein the retaining means providing step comprises providing at least one compartment.

23. A method, as recited in claim 22, wherein the retaining means providing step comprises providing means for separating at least two compartments, and wherein the retaining means providing step comprises providing each said compartment for accommodating at least one product.

24. A method, as recited in claim 23, wherein the separating means providing step comprises providing a wall structure.

25. A method, as recited in claim 22, wherein the at least one compartment providing step comprises providing at least one complementary contour for accommodating the at least one product.

26. A method, as recited in claim 20, wherein the at least one product providing step comprises providing at least one battery cell.

27. A method, as recited in claim 20, wherein the inner packaging member providing step comprises providing the inner packaging member having at least one coincident orifice for facilitating displaying the at least one product by hanging, and wherein the outer packaging member providing step comprises providing the outer packaging member having at least one coincident orifice for facilitating displaying the at least one product by hanging.

28. A method, as recited in claim 20, wherein the inner packaging member providing step comprises providing the inner packaging member comprising a material having an optical property selected from a group consisting of transparency, translucency, and opacity.

29. A method, as recited in claim 20, wherein the outer packaging member providing step comprises providing the outer packaging member comprising a material having an optical property selected from a group consisting of transparency and translucency.

30. A method, as recited in claim 20, wherein the outer packaging member providing step comprises providing at least two flanges for accommodating and supporting at least one insert.

31. A method, as recited in claim 20, wherein the outer packaging member providing step comprises providing a roof member, the roof member comprising an upper surface of the outer packaging member.

32. A method, as recited in claim 20, wherein the inner packaging member providing step comprises providing a floor member for facilitating standing of the apparatus on a horizontal surface.

33. A method, as recited in claim 32, wherein the inner packaging member providing step comprises providing the inner packaging member having at least one coincident orifice for facilitating displaying the at least one product by hanging, and wherein the outer packaging member providing step comprises providing the outer packaging member having at least one coincident orifice for facilitating displaying the at least one product by hanging.

34. A method, as recited in claim 20, wherein the outer packaging member providing step and the inner packaging member providing step together comprise providing a complementary geometric configuration.

35. A method, as recited in claim 20, wherein the outer packaging member providing step comprises providing a section for accommodating an advertisement of the at least one product.

36. A method, as recited in claim 20, wherein the inner packaging member providing step comprises providing at least one variable dimension for accommodating at least one variable aspect of the at least one product selected from a group consisting of size, shape, and number, and wherein the outer packaging member providing step comprises providing at least one variable dimension for accommodating at least one variable aspect of the at least one product selected from a group consisting of size, shape, and number.

37. A method, as recited in claim 20, wherein the inner packaging member providing step comprises providing means for retaining the at least one product, wherein the inner packaging member providing step comprises providing the inner packaging member having at least one coincident orifice for facilitating displaying the at least one product by hanging, wherein the inner packaging member providing step comprises providing a floor member for facilitating standing of the apparatus on a horizontal surface, wherein the outer packaging member providing step comprises providing the outer packaging member having at least one coincident orifice for facilitating displaying the at least one product by hanging, and wherein the outer packaging member providing step and the inner packaging member providing step together comprise providing a complementary geometric configuration.

38. A method, as recited in claim 37, wherein the inner packaging member providing step comprises providing a material having an optical property selected from a group consisting of transparency, translucency, and opacity, wherein the inner packaging member providing step comprises providing at least one variable dimension for accommodating at least one variable aspect of the at least one product selected from a group consisting of size, shape, and number, wherein the retaining means providing step comprises providing at least one compartment, wherein the retaining means providing step comprises providing means for separating the at least one compartment, wherein the separating means providing step comprises providing a wall structure, wherein the at least one compartment providing step comprises providing at least one complementary contour for accommodating the at least one product, wherein the at least one product providing step comprises providing at least one battery cell, wherein the outer packaging member providing step comprises providing a backing member, wherein the outer packaging member providing step comprises providing a roof member, wherein the outer packaging member providing step comprises providing a material having an optical property selected from a group consisting of transparency and translucency, wherein the backing member providing step comprises providing at least one insert, wherein the outer packaging member providing step comprises providing at least two flanges for accommodating and supporting the at least one insert, wherein the outer packaging member providing step comprises providing at least one variable dimension for accommodating at least one variable aspect of the at least one product selected from a group consisting of size, shape, and number.

* * * * *

UNITED STATES PATENT AND TRADEMARK OFFICE

CERTIFICATE OF CORRECTION

PATENT NO. : 7,036,664 B2
APPLICATION NO. : 10/224810
DATED : May 2, 2006
INVENTOR(S) : Kendrew Lee and Yasuhiro Yamamoto It is certified that error appears in the above-identified patent and that said Letters Patent is hereby corrected as shown below:

On Title Page,
In the title (Item 54): after the words "apparatus for" please delete the word [Making] and replace with the word -- Mating --.

On Title Page,
In the title, column 1, line 1: after the words "apparatus for" please delete the word [Making] and replace with the word -- Mating --.

Signed and Sealed this

First Day of August, 2006

JON W. DUDAS
*Director of the United States Patent and Trademark Office*